United States Patent [19]

Masumoto et al.

[11] Patent Number: 4,473,401

[45] Date of Patent: Sep. 25, 1984

[54] AMORPHOUS IRON-BASED ALLOY EXCELLING IN FATIGUE PROPERTY

[75] Inventors: Tsuyoshi Masumoto, No. 8-22, Kamisugi 3-chome, Sendai-shi, Miyagi; Akihisa Inoue, Miyagi; Michiaki Hagiwara, Kyoto, all of Japan

[73] Assignees: Tsuyoshi Masumoto, Miyagi; Unitika Ltd., Hyogo, both of Japan

[21] Appl. No.: 500,706

[22] Filed: Jun. 3, 1983

[30] Foreign Application Priority Data

Jun. 4, 1982 [JP] Japan ..... 57-95721

[51] Int. Cl.[3] ..... C22C 38/32

[52] U.S. Cl. ..... 75/126 P; 75/126 F; 75/126 D; 75/126 E; 75/126 Q; 75/126 H; 75/126 K; 148/35

[58] Field of Search ..... 75/126 P, 126 B, 126 F, 75/126 D, 126 E, 126 H, 128 F, 126 Q, 126 K; 148/35, 36

[56] References Cited

U.S. PATENT DOCUMENTS 3,986,867 10/1976 Masumoto et al. ..... 75/126 P 4,052,201 10/1977 Polk et al. ..... 75/126 P

FOREIGN PATENT DOCUMENTS 56-00257 1/1981 Japan ..... 75/126 P

*Primary Examiner*—L. Dewayne Rutledge

*Assistant Examiner*—Debbie Yee

*Attorney, Agent, or Firm*—Sughrue, Mion, Zinn, Macpeak, and Seas

[57] ABSTRACT

An amorphous iron-based alloy which comprises not more than 25 atom % of Si and 2.5 to 25 atom % of B (providing that the sum of Si and B falls in the range of 15 to 35 atom %), 1.5 to 20 atom % of Cr, 0.2 to 10 atom % of either or both of P and C, and the balance to make up 100 atom % substantially of Fe excels in fatigue property. An amorphous iron-based alloy which contains not more than 30 atom % of at least one element selected from the group consisting of Co, Ni, Ta, Nb, Mo, W, V, Mn, Ti, Al, Cu and Zr in addition to the components making up the aforementioned alloy excels in amorphous texture of forming ability and fatigue property. Since these alloys are also excellent in tensile strength at fracture, thermal resistance, corrosionproofness, and electromagnetic property, they prove highly useful as electromagnetic materials and as reinforcements in various industrial materials.

16 Claims, 2 Drawing Figures

AMORPHOUS IRON-BASED ALLOY EXCELLING IN FATIGUE PROPERTY

FIELD OF THE INVENTION

This invention relates to an amorphous iron-based alloy which excels in amorphous texture forming ability and fatigue property.

BACKGROUND OF THE INVENTION

Ordinary metals in their solid state assume a crystalline texture. Under special conditions (alloy composition and sudden cooling and solidification), even in their solid state, they acquire an atomic structure which, similarly to a liquid, does not contain any crystalline texture. Metals and alloys which possess such an atomic structure are called amorphous. When such an amorphous alloy is made of component elements selected suitably and used in proper proportions, it will excel conventional practical crystalline metal materials in chemical, electromagnetic, physical, mechanical properties, and the like. Accordingly, such a material has a high possibility of finding extensive utility in applications such as electrical and electromagnetic parts, composites, and textile materials. Amorphous alloys possessing high magnetic permeability are disclosed in Japanese patent application (OPI) Nos. 73920/76 and 35618/78 (the term "OPI" as used herein refers to a "published unexamined Japanese patent application"), amorphous alloys excelling in strength, corrosionproofness, and thermal resistance are disclosed in Japanese patent application (OPI) Nos. 101215/75 and 3312/76; and typical amorphous alloys excelling in thermal stability are disclosed in Japanese Patent Publication No. 19976/80 (U.S. Pat. No. 3,856,513). Among the amorphous alloys which have various outstanding characteristics as described above, iron-based alloys are characterized by low prices of raw materials available, high degrees of tensile strength at fracture as compared with conventional practical crystalline metal materials, virtual absence of work hardening, and outstanding toughness. Therefore, they prove useful as materials for a wide variety of industrial products such as reinforcing agents, complexing agents, fibrous materials, etc. Among other amorphous iron-based alloys, Fe-S-B type alloys possess high tensile strength at fracture reaching a maximum even exceeding 400 kg/mm$^2$. Further, the Fe-Si-B type alloys have been known as amorphous iron-based alloys possessing unusually high degrees of thermal resistance as compared with other iron-metalloid type alloys. From the standpoint of the practical utility of metal materials, in the case of the materials used in the parts on which external forces act statically, their properties are evaluated with emphasis on the results of tensile test, particularly those on the tensile strength at fracture. In the case of the materials for belts, tires, ropes, and machine parts which produce rotating or reciprocating motions at high rates of speed (dynamic materials), however, the results of test for tensile strength, particularly those on the tensile strength at fracture, do not deserve any attentive consideration. This is because forces repetitively act on these materials for long periods of time and, in many cases, inevitably entail such phenomena as vibrations. Accordingly, actual fractures occur in these materials without such heavy deformation as would be observed in the test for tensile strength. These fractures induce fatigue breaking under much lower stress than the tensile strength at fracture or even the yield point. This fatigue property is the most important attribute for dynamic materials. If a given dynamic material possesses outstanding tensile strength at fracture, it still cannot be advantageously utilized unless it is also excellent in the fatigue property. As regards mechanical properties of amorphous alloys, the results of the tensile test and the compression test performed on a wide variety of alloys have been reported in a number of publications. Concerning the study on the fatigue property which is important from the practical point of view, the results obtained by Masumoto, Ogura, et al., on $Pd_{80}Si_{20}$ amorphous alloy ribbons (*Scripta Metallugica*, Vol. 9, pp. 109–114, 1975) and those obtained by Imura, Doi, et al., on Ni-based, Febased, and Co-based amorphous alloy ribbons (*Jpn. J. Appl. Phys.*, 19, 449, 1980 and *Jpn. J. Appl. Phys.*, 20, 1593, 1981) are about all the reports found in literature. From the results of the study by Imura, Doi, et al., it is noted that the $Fe_{75}Si_{10}B_{15}$ amorphous alloy ribbons possessing high strength showed the same level of fatigue property as the existing crystalline SUS 304 and registered a fatigue limit, $\lambda e=0.0018$. This means that the amorphous alloy ribbons of $Fe_{75}Si_{10}B_{15}$ shows no appreciable improvement in fatigue property for its high tensile strength at fracture and exhibits rather low fatigue ratio as compared with counterpart materials now in practical use.

Japanese patent application (OPI) No. 4017/76 discloses an amorphous iron alloy which has as its main component an Fe-(P, C, B)-Cr type alloy intended primarily for improvement of corrosionproofness (resistance to surface corrosion, resistance to pitting, resistance to interstitial corrosion, and resistance to stress-corrosion cracking) and additionally as a secondary component varying elements. This alloy is claimed to be useful for preparation of reinforcing cords to be buried in rubber and plastic products such as automotive tires and conveyor belts. This patent application claims a patent for an amorphous iron alloy possessing high strength and stability to resist fatigue, surface corrosion, pitting, interstitial corrosion, stress-corrosion cracking, and hydrogenation embrittlement, which amorphous iron alloy contains as main components thereof 1 to 40 atom% of Cr and 7 to 35 atom% of at least one element selected from among P, C, and B, further contains as a secondary component thereof at least one of the following four members:

(1) 0.01 to 40 atom% of either or both of Ni and Co,
(2) 0.01 to 20 atom% of at least one element selected from the group consisting of Mo, Zr, Ti, Si, Al, Pt, Mn, and Pd,
(3) 0.01 to 10 atom% of at least one element selected from the group consisting of V, Nb, Ta, W, Ge, and Be, and
(4) 0.01 to 5 atom% of at least one element selected from the group consisting of Au, Cu, Zn, Cd, Sn, As, Sb, Bi, and S in a combined amount falling in the range of 0.01 to 75 atom%, and has the balance to make up 100 atom% substantially of Fe. The alloy which is specifically disclosed in Japanese patent application (OPI) No. 4017/76 is in a composition of $Fe_{67}Cr_3Si_{15}B_1P_{13}C_1$, thus using Fe-Si-P-Cr as its main components. Although this alloy excels in corrosionproofness (resistance to surface corrosion, resistance to pitting, resistance to interstitial corrosion, and resistance to stress-corrosion cracking), it possesses very poor amorphous texture forming ability and exhibits no appreciably improved fatigue property. Thus, the alloy falls short of being useful as the dynamic materials defined above.

The inventors of this invention formerly filed a patent application covering a filament of circular cross section made of an amorphous iron-based alloy excelling in corrosionproofness, toughness, and electromagnetic property and useful as industrial materials for the production of electric and electronic parts, composites, and textile articles and to a method for the manufacture of the filament (U.S. Ser. No. 254,714 and EPC Disclosure No. 39169). In some of the working examples cited in the specification thereof, $Fe_{71}Cr_{10}Si_{10}B_9$ alloy, $Fe_{70}Cr_5Si_{10}B_{15}$ alloy and $Fe_{50}Co_{20}Cr_5Si_{10}B_{15}$ alloy resulting from addition of Cr to the Fe-Si-B type alloy composition are indicated. The addition of Cr in the prior art is aimed at improving thermal resistance and strength, but it is not aimed at fatigue property. In the possible alloy compositions contemplated by this patent application, the $Fe_{70}Cr_5Si_{10}B_{15}$ alloy and $Fe_{50}Co_{20}Cr_5Si_{10}B_{15}$ alloy which incorporate 5 atom% of Cr show practically no discernible improvement in fatigue property and the $Fe_{71}Cr_{10}Si_{10}B_9$ alloy which incorporates 10 atom% of Cr possesses poor amorphous texture forming ability.

SUMMARY OF THE INVENTION

An object of this invention is to provide an amorphous iron-based alloy possessing high tensile strength at fracture and high toughness and excelling in amorphous texture forming ability and fatigue property.

The inventors of the present invention made a diligent study with a view to accomplishing the object described above. The present inventors have consequently ascertained that addition of a specific amount of Cr and a specific amount of P or C to the Fe-Si-B type alloy composition brings about notable improvement in amorphous texture forming ability and fatigue property. After further continuing the study, they have also ascertained that addition to the alloy mentioned above of specific amounts of elements selected from the group consisting of Co, Ni, Ta, Nb, Mo, W, V, Mn, Ti, Al, Cu and Zr confers upon the produced alloy notable improvement in electromagnetic property, thermal resistance, corrosionproofness, or mechanical property in addition to amorphous texture forming ability and fatigue property. These findings have led to completion of the present invention.

Specifically, this invention relates to an amorphous iron-based alloy excelling in amorphous texture forming ability and fatigue property, comprising not more than 25 atom% of Si, 2.5 to 25 atom% of B, 1.5 to 20 atom% of Cr, 0.2 to 10 atom% of either or both of P and C, and the balance to make up 100 atom% substantially of Fe, providing that the sum of Si and B falls in the range of 15 to 35 atom% and to an amorphous iron-based alloy excelling in amorphous texture forming ability and fatigue property, comprising not more than 25 atom% of Si and 2.5 to 25 atom% of B (providing that the sum of Si and B falls in the range of 15 to 35 atom%), 1.5 to 20 atom% of Cr, 0.2 to 10 atom% of either or both of P and C, not more than 30 atom% of at least one element selected from the group consisting of Co, Ni, Ta, Nb, Mo, W, V, Mn, Ti, Al, Cu and Zr, and the balance to make up 100 atom% substantially of Fe (providing that the maximum Co content is 30 atom% and that the maximum Ni content is 20 atom%, and the maximum Ta and Nb contents are 10 atom% each, those of Mo, W, V and Mn contents are 5 atom% each, and those of Ti, Al, Cu and Zn contents are 2.5 atom% each).

Since the alloys of this invention excel in tensile strength at fracture, thermal resistance, corrosionproofness, and electromagnetic property as well as in amorphous texture forming ability and fatigue property, they prove highly useful for the production of reinforcements in rubber and plastic products such as conveyor belts and automotive tires, composites as with concrete and glass, various industrial reinforcing materials, knit and woven products represented by finemesh mesh filters, and electromagnetic materials represented by electromagnetic filters and sensors.

The other objects and characteristic features of this invention will become apparent to those skilled in the art as the disclosure is made in the following description of a preferred embodiment of the invention, as illustrated in the accompanying sheet of drawings.

DETAILED DESCRIPTION OF THE INVENTION

Figure 1:
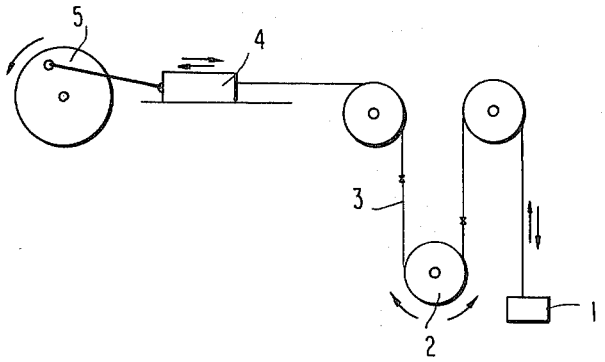
FIG. 1 is a schematic diagram of a modelflexing type fatigue tester used for measurement of fatigue property.

The amorphous alloy of the present invention has an Si content of not more than 25 atom%, a B content in the range of 2.5 to 25 atom%, and the sum of the Si and B contents in the range of 15 to 35 atom%. These are the elements and their amounts of incorporation which are indispensable to the production of an amorphous alloy by sudden cooling and solidification of the Fe-Si-B type alloy composition from its molten state. If the Si or B content is more than 25 atom%, if the B content is less than 2.5 atom%, or if the Si content is less than 25 atom% and the B content falls in the range of 2.5 to 25 atom% and yet the sum of the Si and B contents is less than 15 atom% or more than 35 atom%, the fused mixture produced resultantly fails to form an amorphous alloy even when it is suddenly cooled and solidified and gives rise to a highly brittle useless crystalline alloy instead. The tensile strength at fracture exhibited by the Fe-Si-B type alloy increases proportionally as the sum of the Si and B contents, particularly the B content, increases. The amorphous texture forming ability of this alloy reaches its peak when the Si content is 10 atom% and the B content is in the neighborhood of 15 atom%. This ability decreases as the sum of the Si and B contents is increased or decreased from the levels mentioned. All considered, therefore, the alloy composition is desired to be such that the Si content is not more than 17.5 atom%, the B content falls in the range of 5 to 22.5 atom%, and the sum of the Si and B contents falls in the range of 17.5 to 32.5 atom%. More preferably, the Si content falls in the range of 3 to 17.5 atom%, particularly preferably 3 to 16 atom%, and the B content falls in the range of 7.5 to 20 atom%, preferably 9 to 20 atom%. The Cr content in the alloy composition is required to fall in the range of 1.5 to 20 atom%. These elements and amounts enhance the fatigue property of the aforementioned Fe-Si-B type amorphous alloy without appreciably sacrificing the amorphous texture forming ability thereof. If the Cr content is less than 1.5 atom%, then the improvement of the fatigue property expected from the addition of Cr is hardly attainable. If the Cr content is increased to more than 20 atom%, the amorphous texture forming ability is extremely low and the improvement of the fatigue property is not attained as expected. The aforementioned Fe-Si-B-Cr type alloy further requires incorporation therein of 0.2 to 10 atom% of either or both of P and C. These elements and amounts heighten the amorphous texture forming ability liable to be impaired by the addition of Cr and also improve the fatigue property further. These elements fail to improve the amorphous texture forming ability and the fatigue property if their amounts of addition exceed the upper limit, or fail to reach the lower limit, of the range specified above. Particularly in the case of the aforementioned Fe-Si-B-Cr type alloy, the P or C content is desired to fall in the range of 0.5 to 5 atom% or the sum of the P and C contents to fall in the range of 1 to 8 atom% where the Cr content is in the range of 3 to 10 atom%. This means that when the Cr content is small, the amorphous texture forming ability and the fatigue property can be simultaneously improved by combined addition of P and C.

The fact that a given alloy is excellent in amorphous texture forming ability implies that it readily and economically produces thick ribbons or thick wires of amorphous texture by the roll method, the centrifugal quenching method, the spinning-in-rotary-liquid method, etc. Where the alloy is not required to produce thick ribbons or thick wires, it is still capable of notably increasing the cooling speed or being used to produce another shaped article of amorphous texture (free from inclusion of crystals or microcrystals) to be easily and uniformly produced without requiring any rigid control of the cooling speed. If the alloy is deficient in the amorphous texture forming ability, then it is barely enabled by a specific method excelling in cooling speed (such as, for example, the roll method) to produce articles of amorphous texture only in a specific shape (ribbons of a very samll thickness).

In another aspect of the present invention, at least one element selected from the group consisting of Co, Ni, Ta, Nb, Mo, W, V, Mn, Ti, Al, Cu and Zr is added in an amount of not more than 30 atom% (providing that the maximum of Co content is 30 atom% and that the maximum Ni content is 20 atom%, and the maximum Ta and Nb contents are 10 atom% each, those of Mo, W, V, and Mn contents are 5 atom% each, and those of Ti, Al, Cu, and Zr contents are 2.5 atom% each) is added to the aforementioned Fe-Si-B-Cr-P type alloy, Fe-Si-B-Cr-C type alloy or Fe-Si-B-Cr-P-C type alloy to give further improvement in electromagnetic property, thermal resistance, corrosionproofness, and mechanical property of the alloy without noticeably impairing the amorphous texture forming ability. If the amount of the element added is too large, the aforementioned properties cannot be notably improved as expected and the amorphous texture forming ability is extremely impaired. Consequently, the composition fails to produce a tough, amorphous alloy. With respect to the elements enumerated as desirable components for the selective addition mentioned above, Co and Ni are the elements which go to improving chiefly electromagnetic property and corrosionproofness, Ta, Nb, Mo, W, V, Mn and Zr are the elements which go to improving chiefly thermal resistance and mechanical property, and Ta, Nb, Mo, W, Ti, Al and Cu are the elements which go to improving corrosionproofness. Moreover, the alloy can be improved also in amorphous texture forming ability by adding thereto Ta in an amount of not more than 8 atom% and Nb, Mo and W each in an amount of not more than 4 atom%. Optionally, other elements such as normal impurities contained in the industrial raw materials may be added to the aforementioned alloy in very small amounts enough to avoid exerting adverse effects upon thermal stability, corrosionproofness, electromagnetic property, mechanical property, amorphous texture forming ability, and fatigue property of the alloy.

Production of the alloy of the present invention is accomplished by preparing the aforementioned alloy composition, heating the composition into a molten state, and suddenly cooling the hot fused composition. Various methods are available for the purpose of this cooling of the fused composition. To produce flat ribbons of amorphous alloy from the fused composition, adoption of the centrifugal quenching method, the one-roll method, or the two-roll method proves advantageous. To obtain shaped products of amorphous alloy having a circular cross section from the fused composition, the method which comprises placing a liquid coolant in a rotary drum thereby causing the liquid coolant to form a whirling layer on the inner wall of the drum by the centrifugal force generated by the rotation of the drum and jetting the fused composition into the whirling layer of liquid coolant thereby cooling and solidifying the fused composition (the spinning-in-rotary-liquid method: U.S. Ser. No. 254,714, EPC Disclosure No. 39169) may be advantageously adopted. Since this method permits the whirling speed of the liquid coolant to be controlled and prevents the coolant in motion from turbulence and enables the flow of fused composition to be passed through the whirling liquid coolant to be cooled and solidified therein by the combination of the jetting pressure of the flow of fused composition and the centrifugal force exerted by the drum, it has a very high cooling speed and is capable of producing wires of amorphous alloy in fairly large diameters. To produce wires of amorphous alloy uniformly in high quality by this method, the spinning nozzle used for jetting the fused composition is desired to be located as closely to the surface of the whirling flow of liquid coolant (preferably within a distance of 5 mm) as possible and the peripheral speed of the rotary drum to be equalized with, or even to exceed, the speed at which the fused composition is jetted through the spinning nozzle. Preferably, the peripheral speed of the rotary drum should be 5 to 30% higher than the speed at which the fused composition is jetted through the spinning nozzle. Further, the jet of fused composition emitted from the spinning nozzle is desired to form an angle of not less than 20° with respect to the whirling layer of liquid coolant formed on the inner wall of the drum.

Comparison between ribbons of amorphous texture produced by the aforementioned liquid quenching method or one-roll method from the aforementioned alloy composition of this invention and wires of amorphous texture having a circular cross section and produced by the spinning-in-rotary-liquid method from the same alloy composition reveals that while they are nearly equal in mechanical and thermal properties, the wires having a circular cross section incredibly excel by far the ribbons in terms of fatigue property. Since the amorphous alloy of excellent fatigue property aimed at by the present invention is made of the aforementioned alloy composition which excels in amorphous texture forming ability, it permits a wire of amorphous texture having a circular cross section to be readily produced by the spinning-in-rotary-liquid method. In the manufacture of such wires, the alloy of this invention manifests its effect more conspicuously. For example, ribbons of amorphous texture 50 μm in thickness produced of the alloy composition, $Fe_{67}Cr_8Si_8B_{12}P_{2.5}C_{2.5}$, of this invention by the one-roll method show 358 kg/mm² of tensile strength at fracture and 0.0060 of fatigue limit (λe), whereas wires of amorphous texture having a circular cross section 100 μm in diameter produced of the same alloy composition by the spinning-in-rotary-liquid method show 365 kg/mm² of tensile strength at fracture and 0.012 of fatigue limit (λe). Thus, the wires evidently excel the ribbons in fatigue property when they are made of one and the same alloy composition.

The amorphous alloy of this invention can be continuously cold worked. By drawing the alloy composition of the present invention through a commercially available diamond die, for example, a uniform wire of amorphous texture possessing high tensile strength at fracture and high elongation can be produced economically from the alloy.

Further, since the alloy of the present invention is excellent in tensile strength at fracture, thermal resistance, corrosionproofness, and electromagnetic property as well as in amorphous texture forming ability and fatigue property as described above, it finds extensive utility in applications to rubber and plastic reinforcing materials such as conveyor belts and automotive tires, composites such as with concrete and glass, various industrial reinforcing materials, knit and woven articles represented by fine-mesh filters, and electromagnetic articles represented by electromagnetic filters and sensors.

Now, the present invention will be described more specifically below with reference to working examples. However, the scope of the invention is not limited to these examples.

In the examples, the fatigue property was rated as follows.

Figure 2:
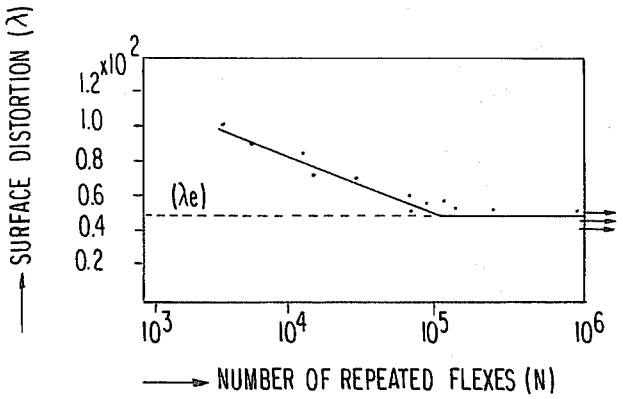
FIG. 2 is a graph showing an S-N curve determined with the aid of the device of FIG. 1. In this graph, the vertical axis is the scale for the surface distortion of a test piece (λ) and the horizontal axis is the scale for the number of repeated flexes (N).

(1) Fatigue limit (λe): On a model flexing fatigue tester (designed to produce repeated flexes in one direction) illustrated in FIG. 1, a given test piece was flexed at a fixed rate of 100 cycles/min. under a fixed load, W (a load per unit cross-sectional area: 4 kg/mm²), with the pulley diameter varied for adjusting the surface strain (λ) of the test piece, to obtain an S-N curve (on a graph wherein the vertical axis was the scale of surface strain (λ) and the horizontal axis was the scale of number of cycles, N) as illustrated in FIG. 2. The particular surface strain of the test piece at which the S-N curve described a level line was reported as the fatigue limit (λe) of this test piece. In general, the preferred fatigue limit value (λe) is 0.0025 or more in the case of ribbons, more preferably 0.0035 or more, or 0.7 or more in the case of wires, more preferably 0.8 or more. The surface strain (λ) of the test piece was calculated in accordance with the following formula:

$$\lambda = t/2r$$

(wherein t stands for the thickness of the test piece (diameter in the case of a wire) and r for the radius of the pulley).

In the diagram, 1 stands for the load required for exerting a fixed load per unit cross-sectional area (mm²) (4 kg/mm²) upon the test piece, 2 for the pulley used for adjusting the surface strain of the test piece, 3 for the test piece, 4 for the slider for horizontal movement, and 5 for the circular rotary plate.

(2) Fatigue ratio (fe): The fatigue ratio (fe) of a given test piece was determined in accordance with the following formula.

$$fe = \frac{\text{Surface stress of test piece at fatigue limit (kg/mm}^2)}{\text{Tensile strength at fracture (kg/mm}^2)}$$

$$= \frac{\lambda e \times \text{Young's modulus of test piece (kg/mm}^2)}{\text{Tensile strength at fracture (kg/mm}^2)}$$

The tensile strength at fracture and the Young's modulus of the test piece were obtained in accordance with the S—S curve obtained on an Instron type tensile tester under the conditions 2.0 cm of test piece size and $4.17 \times 10^{-4}$/sec. of strain speed.

Further in the examples, the amorphous texture forming ability of a given alloy composition was determined by jetting the alloy composition in a molten state through a spinning nozzle 0.50 mm in orifice diameter onto the surface of a rotary roll of copper 20 cm in diameter, allowing the jet of fused alloy composition to be suddenly cooled and solidified to produce a ribbon of continuously changing thickness (by stopping the rotary roll during the issue of the fused alloy composition), testing the produced ribbon for its texture with an optical microscope and an X-ray diffraction meter, and finding the particular thickness of the ribbon at which crystals were first detected in the texture, i.e., the critical thickness (μm) for the formation of amorphous phase. In general, the preferred thickness is 80 μm or more, more preferably 100 μm or more, most preferably 150 μm or more.

EXAMPLES 1-7 AND COMPARATIVE EXPERIMENTS 1-5

An alloy of a varying composition shown in Table 1 was fused under a blanket of argon. Under an argon gas pressure of 1.5 kg/cm², the resultant fused alloy composition was spouted through a spinning nozzle 0.20 mm in orifice diameter onto the surface of a steel roll 20 cm in diameter kept in rotation (one-roll method) and was allowed to cool and solidify suddenly and produce a ribbon of amorphous texture 40 μm in thickness (about 2 mm in width).

The ribbon of amorphous texture thus obtained was tested for tensile strength at fracture and fatigue property in an atmosphere maintained at 20° C. and 65% RH. The results were as shown in Table 1.

TABLE 1

| Run No. | Alloy Composition (atom %) | Tensile Strength at Fracture (kg/mm²) | Fatigue Property: Fatigue Limit (λe × 10²) | Fatigue Property: Fatigue Ratio (fe) | Amorphous Texture Forming Ability (μm) |
|---|---|---|---|---|---|
| 1 Comparative Experiment 1 | $Fe_{75}Si_{10}B_{15}$ | 342 | 0.18 | 0.06 | 250 |
| 2 Example 1 | $Fe_{68}Cr_2Si_{10}B_{15}P_2C_3$ | 340 | 0.28 | 0.09 | 200 |

TABLE 1-continued

| Run No. | Alloy Composition (atom %) | Tensile Strength at Fracture ($kg/mm^2$) | Fatigue Property: Fatigue Limit ($\lambda e \times 10^2$) | Fatigue Property: Fatigue Ratio (fe) | Amorphous Texture Forming Ability ($\mu m$) |
|---|---|---|---|---|---|
| 3 Example 2 | $Fe_{69}Cr_4Si_{10}B_{15}P_2$ | 346 | 0.34 | 0.11 | 205 |
| 4 Example 3 | $Fe_{68}Cr_4Si_{10}B_{15}C_3$ | 348 | 0.37 | 0.12 | 285 |
| 5 Comparative Experiment 2 | $Fe_{70}Cr_5Si_{10}B_{15}$ | 344 | 0.20 | 0.07 | 140 |
| 6 Example 4 | $Fe_{70}Cr_5Si_9B_{14}C_2$ | 345 | 0.41 | 0.13 | 260 |
| 7 Example 5 | $Fe_{70}Cr_5Si_7B_{11}P_2C_5$ | 341 | 0.40 | 0.13 | 220 |
| 8 Comparative Experiment 3 | $Fe_{65}Cr_5Si_7B_{11}P_7C_5$ | 343 | 0.19 | 0.06 | 160 |
| 9 Comparative Experiment 4 | $Fe_{71}Cr_{10}Si_{10}B_9$ | 327 | 0.55 | 0.20 | 65 |
| 10 Example 6 | $Fe_{66}Cr_{10}Si_{10}B_9P_{2.5}C_{2.5}$ | 331 | 0.60 | 0.21 | 210 |
| 11 Example 7 | $Fe_{62}Cr_{14}Si_{10}B_9P_{2.5}C_{2.5}$ | 335 | 0.52 | 0.18 | 185 |
| 12 Comparative Experiment 5 | $Fe_{67}Cr_3Si_{15}B_1P_{13}C_1$ | 290 | 0.27 | 0.10 | 50 |

In Run No. 1, since the alloy composition had no Cr content, the produced ribbon showed poor fatigue property despite its excellent amorphous texture forming property. In Run No. 5, although the alloy composition incorporated 5 atom% of Cr alone in addition to the alloy composition of Run No. 1, the produced ribbon showed very little improvement in fatigue property and exhibited very poor amorphous texture forming ability, indicating that the addition of Cr failed to bring about the expected effect. In Run No. 9, the alloy composition similarly incorporated 10 atom% of Cr alone and the produced ribbon showed some improvement in fatigue property. However, its amorphous texture forming ability was extremely impaired. (Note that the alloy compositions used in Run Nos. 1, 5 and 9 are those indicated in U.S. Ser. No. 254,714, EPC Disclosure No. 39169.) In Run Nos. 2, 3, 4, 6, 7, 10 and 11, the alloy compositions incorporated Cr and P or C in amounts falling in the specified ranges in addition to the Fe-Si-B type alloy as contemplated by the present invention and the produced ribbons, therefore, were found to excel in amorphous texture forming ability and in fatigue property as well. In Run No. 11, although the alloy composition incorporated 14 atom% of Cr and, therefore, had a higher Cr content than the alloy composition of Run No. 10, the produced ribbon showed rather inferior amorphous texture forming ability and fatigue property than the ribbon of Run No. 10. In Run No. 8, the produced ribbon showed no discernible improvement in amorphous texture forming ability and fatigue property because the alloy composition incorporated P and C in a larger combined amount of 12 atom% than is allowed. In Run No. 12, the alloy had the same composition as the alloy of Example 11 of Japanese patent application (OPI) No. 4017/76. Since this alloy composition had a larger P content of 13 atom% and a smaller B content of 1 atom% than are required, the produced ribbon, though slightly improved in fatigue property, suffered from very poor amorphous texture forming ability and lacked feasibility.

EXAMPLES 8–10 AND COMPARATIVE EXPERIMENTS 6–12

An alloy of a varying composition shown in Table 2 was fused under a blanket of argon. Under an argon gas pressure, the resultant fused alloy composition was spouted through a spinning nozzle of ruby 0.105 mm in orifice diameter into a whirling layer of liquid coolant 2.5 cm in dpeth and 4° C. in temperature formed on the inner wall of a cylindrical drum 500 mm in inside diameter rotated at 350 rpm, to be suddenly cooled and solidified therein. Consequently, there was obtained a uniform continuous wire having a circular cross section 0.100 mm in average diameter. During the production of the wire, the tip of the spinning nozzle was kept at a distance of 1 mm from the surface of the whirling layer of liquid coolant and the angle of contact between the flow of fused alloy composition spouted through the spinning nozzle and the surface of the whirling layer of liquid coolant was kept at 75°. The speed at which the fused alloy composition was spouted through the spinning nozzle was measured on the basis of the weight of fused composition spouted into the ambient air and collected in the air for a fixed length of time. During this measurement, the argon gas pressure was adjusted so that the fused composition would be spouted at a rate of about 500 m/minute.

The wire of amorphous texture thus produced was tested for tensile strength at fracture and fatigue property in an atmosphere maintained under the conditions of 20° C. and 65% RH. The results were as shown in Table 2.

For the purpose of comparison, a commercially available piano wire (0.100 mm in diameter, material code SWRS 82A, and piano wire code SWPA) was similarly tested. The results were indicated in the bracket of Comparative Experiment 12 in Table 2.

TABLE 2

| Run No. | Alloy Composition (atom %) | Tensile Strength at Fracture ($kg/mm^2$) | Fatigue Property: Fatigue Limit ($\lambda e \times 10^2$) | Fatigue Property: Fatigue Ratio (fe) |
|---|---|---|---|---|
| 13 Comparative Experiment 6 | $Pd_{77.5}Cu_{6.5}Si_{16}$ | 132 | 0.55 | 0.30 |
| 14 Comparative Experiment 7 | $Co_{72.5}Si_{12.5}B_{15}$ | 337 | 0.50 | 0.18 |

TABLE 2-continued

| Run No. | Alloy Composition (atom %) | Tensile Strength at Fracture ($kg/mm^2$) | Fatigue Property: Fatigue Limit ($\lambda e \times 10^2$) | Fatigue Property: Fatigue Ratio (fe) |
|---|---|---|---|---|
| 15 Comparative Experiment 8 | $Fe_{77.5}P_{12.5}C_{10}$ | 294 | 0.40 | 0.13 |
| 16 Comparative Experiment 9 | $Fe_{75}Si_{10}B_{15}$ | 348 | 0.43 | 0.14 |
| 17 Example 8 | $Fe_{68}Cr_4Si_{10}B_{15}C_3$ | 355 | 0.75 | 0.24 |
| 18 Comparative Experiment 10 | $Fe_{70}Cr_5Si_{10}B_{15}$ | 350 | 0.44 | 0.14 |
| 19 Example 9 | $Fe_{70}Cr_5Si_7B_{11}P_2C_5$ | 355 | 0.82 | 0.27 |
| 20 Example 10 | $Fe_{66}Cr_{10}Si_{10}B_9P_{2.5}C_{2.5}$ | 335 | 1.05 | 0.36 |
| 21 Comparative Experiment 11 | $Fe_{67}Cr_3Si_{15}B_1P_{13}C_1$ | Produced wire had no amorphous texture and was very brittle. | | |
| 22 Comparative Experiment 12 | Piano wire | 285 | 0.55 | 0.34 |

In Run No. 13, the produced wire showed fair fatigue property and poor tensile strength at fracture and the alloy composition was expensive and, hence, the product was deficient in feasibility. In Run No. 14, although the wire showed slightly better fatigue property than the Fe-based alloys of Run Nos. 15 and 16, it was deficient in tensile strength at fracture and fatigue property, but produced for the same cost as the alloy composition of Run No. 13. The alloy compositions used in Run Nos. 16, 17, 18, 19, 20 and 21 were the same as the alloy compositions of Run Nos. 1, 4, 5, 7, 10 and 12, respectively. The alloy composition of Run No. 16 which incorporated no Cr and the alloy composition of Run No. 18 which incorporated 5 atom% of Cr alone (equalling the alloy compositions indicated in U.S. Ser. No. 254,714 and EPC Disclosure No. 39169) gave wires of poor fatigue property. The alloy compositions of Run Nos. 17, 19 and 20 incorporated Cr and P and/or C in amounts falling within the ranges contemplated by the present invention gave excellent fatigue property due to the addition of these elements. It is surprising to note that although entirely the same alloy compositions were used in the pairs of Run Nos. 1 and 16, Run Nos. 4 and 17, Run Nos. 5 and 18, Run Nos. 7 and 19, and Run Nos. 10 and 20, the wires of amorphous texture having a circular cross section by the spinning-in-rotary-liquid method in Run Nos. 16, 17, 18, 19 and 20 showed notably higher fatigue property than the ribbons of amorphous texture produced by the one-roll method in Run Nos. 1, 4, 5, 7 and 10. In Run No. 21, although the alloy composition was identical with the alloy composition of Run No. 12 (the alloy composition indicated in Example 11 of Japanese patent application (OPI) No. 4016/76), since it was deficient in amorphous texture forming ability, the wire 0.100 mm in diameter produced by the spinning-in-rotary-liquid method failed to acquire amorphous texture and instead assumed a crystalline texture. Thus, the wire was too brittle to withstand the test conditions of tensile strength at fracture and fatigue property.

EXAMPLES 11–14 AND COMPARATIVE EXPERIMENTS 13–16

An alloy of a varying composition, $Fe_{70-x}Cr_5M_xSi_9B_{14}C_2$ (wherein M stands for Ta, Nb, W or Mo) was treated by the procedure of Example 1 using the one-roll method to produce a ribbon 50 μm in thickness (about 2 mm in width). The produced ribbon was tested for tensile strength at fracture, fatigue limit, temperature of crystallization, 180° intimate bending property, and amorphous texture forming ability. The results were as shown in Table 3.

TABLE 3

| Run No. | Alloy Composition (atom %) | Tensile Strength at Fracture ($kg/mm^2$) | Fatigue Limit ($\lambda e \times 10^2$) | Temperature of Crystallization (°C.) | 180° Intimate Bending Property | Amorphous Texture Forming Property (μm) |
|---|---|---|---|---|---|---|
| 23 Example 11 | $Fe_{63}Cr_5Ta_7Si_9B_{14}C_2$ | 372 | 0.42 | 559 | Possible | 270 |
| 24 Comparative Experiment 13 | $Fe_{58}Cr_5Ta_{12}Si_9B_{14}C_2$ | 375 | 0.32 | 564 | Impossible | 105 |
| 25 Example 12 | $Fe_{63}Cr_5Nb_7Si_9B_{14}C_2$ | 360 | 0.43 | 558 | Possible | 180 |
| 26 Comparative Experiment 14 | $Fe_{58}Cr_5Nb_{12}Si_9B_{14}C_2$ | 368 | 0.35 | 562 | Impossible | 60 |
| 27 Example 13 | $Fe_{67}Cr_5W_3Si_9B_{14}C_2$ | 353 | 0.43 | 548 | Possible | 280 |
| 28 Comparative Experiment 15 | $Fe_{62}Cr_5W_8Si_9B_{14}C_2$ | 357 | 0.34 | 554 | Impossible | 55 |
| 29 Example 14 | $Fe_{67}Cr_5Mo_3Si_9B_{14}C_2$ | 352 | 0.42 | 547 | Possible | 270 |
| 30 Comparative Experiment 16 | $Fe_{62}Cr_5Mo_8Si_9B_{14}C_2$ | 356 | 0.31 | 552 | Impossible | 70 |

In Run Nos. 23, 25, 27 and 29, the alloy compositions conformed to the specification of the present invention. Compared with the ribbon obtained in Run No. 6 (Example 4; ribbon of amorphous texture of $Fe_{70}Cr_5Si_9B_{14}C_2$ having 532° C. of crystallization temperature), the ribbons produced from the aforementioned alloy compositions showed nearly equivalent degrees of fatigue limit and the degrees of tensile strength at fracture improved by 7 to 27 $kg/mm^2$, and the degrees of crystallization temperature improved by 15 to 27° C., indicating that the incorporation of Ta, Nb, W and Mo was effective for such improvement. In Run Nos. 24, 26, 28 and 30, however, since the alloy compositions incorporated such elements excessively, the produced ribbons showed inferior amorphous texture forming ability and too low toughness to withstand the test conditions of 180° intimate bending property and they also were deficient in fatigue property.

While the invention has been described in detail and with reference to specific embodiments thereof, it will be apparent to one skilled in the art that various changes and modifications can be made therein without departing from the spirit and scope thereof.

What is claimed is:

1. An amorphous iron-based alloy excelling in amorphous texture forming ability and fatigue property, consisting essentially of:
   25 atom% or less of Si;
   2.5 to 25 atom% of B;
   1.5 to 20 atom% of Cr;
   0.2 to 10 atom% of at least one element selected from the group consisting of P and C; and
   the balance to make up 100 atom% substantially of Fe, providing that the sum of Si and B falls in the range of 17.5 to 35 atom%.

2. An amorphous alloy as claimed in claim 1, wherein the Si content does not exceed 17.5 atom%, the B content falls in the range of 5 to 22.5 atom%, and the sum of the Si and B contents falls in the range of 17.5 to 32.5 atom%.

3. An amorphous alloy as claimed in claim 2, wherein the Cr content falls in the range of 3 to 10 atom% and the P or C content falls in the range of 0.5 to 5 atom%.

4. An amorphous alloy as claimed in claim 2, wherein the Cr content falls in the range of 3 to 10 atom% and the sum of the P and C contents falls in the range of 1 to 8 atom%.

5. A thin wire consisting essentially of an amorphous ironbased alloy excelling in amorphous texture forming ability and fatigue property, comprising:
   25 atom% or less of Si;
   2.5 to 25 atom% of B;
   1.5 to 20 atom% of Cr;
   0.2 to 10 atom% of at least one element selected from the group consisting of P and C; and
   the balance to make up 100 atom% substantially of Fe, providing the sum of Si and B falls in the range of 17.5 to 35 atom%.

6. A thin wire consisting essentially of an amorphous alloy as claimed in claim 5, wherein the Si content is 17.5 atom% or less, the B content falls in the range of 5 to 22.5 atom%, the sum of Si and B contents falls in the range of 17.5 to 32.5 atom%.

7. A thin wire consisting essentially of an amorphous alloy as claimed in claim 5, wherein the Cr content falls in the range of 3 to 10 atom% and the P or C content falls in the range of 0.5 to 5 atom%.

8. A thin wire consisting essentially of an amorphous alloy as claimed in claim 5, wherein the Cr content falls in the range of 3 to 10 atom% and the sum of P and C contents falls in the range of 1 to 8 atom%.

9. An amorphous iron-based alloy excelling in amorphous texture forming ability and fatigue property, consisting essentially of:
   25 atom% or less of Si;
   2.5 to 25 atom% of B, providing that the sum of Si and B falls in the range of 17.5 to 35 atom%;
   1.5 to 20 atom% of Cr;
   0.2 to 10 atom% of at least one element selected from the group consisting of P and C;
   30 atom% or less of at least one element selected from the group consisting of Co, Ni, Ta, Nb, Mo, W, V, Mn, Ti, Al, Cu and Zr; and
   the balance to make up 100 atom% substantially of Fe, providing that the maximum of Co content is 30 atom% and that of Ni content 20 atom%, and the maximum of Ta and Nb contents are 10 atom% each, those of Mo, W, V and Mn contents 5 atom% each, and those of Ti, Al, Cu and Zr 2.5 atom% each.

10. An amorphous alloy as claimed in claim 9, wherein the Si content is not more than 17.5 atom%, the B content falls in the range of 5 to 22.5 atom%, and the sum of the Si and B contents falls in the range of 17.5 to 32.5 atom%.

11. An amorphous alloy as claimed in claim 9, wherein the Cr content falls in the range of 3 to 10 atom% and the P or C content falls in the range of 0.5 to 5 atom%.

12. An amorphous alloy as claimed in claim 9, wherein the Cr content falls in the range of 3 to 10 atom% and the sum of the P and C contents falls in the range of 1 to 8 atom%.

13. A thin wire consisting essentially of an amorphous iron-based alloy excelling in amorphous texture forming ability and fatigue property, comprising:
   25 atom% or less of Si;
   2.5 to 25 atom% of B, providing that the sum of Si and B falls in the range of 17.5 to 35 atom%;
   1.5 to 20 atom% of Cr;
   0.2 to 10 atom% of at least one element selected from the group consisting of P and C;
   30 atom% or less of at least one element selected from the group consisting of Co, Ni, Ta, Nb, Mo, W, V, Mn, Ti, Al, Cu and Zr; and
   the balance to make up 100 atom% substantially of Fe, providing that the maximum of Co content is 30 atom% and that of Ni content 20 atom% and the maximum of Ta and Nb contents are 10 atom% each, those of Mo, W, V and Mn contents 5 atom% each, and those of Ti, Al, Cu and Zr 2.5 atom% each.

14. A thin wire consisting essentially of an amorphous alloy as claimed in claim 13, wherein the Si content is 17.5 atom% or less, the B content falls in the range of 5 to 22.5 atom%, and the sum of Si and B contents falls in the range of 17.5 to 32.5 atom%.

15. A thin wire consisting essentially of an amorphous alloy as claimed in claim 13, wherein the Cr content falls in the range of 3 to 10 atom% and the P or C content falls in the range of 0.5 to 5 atom%.

16. A thin wire consisting essentially of an amorphous alloy as claimed in claim 13, wherein the Cr content falls in the range of 3 to 10 atom% and the sum of P and C contents falls in the range of 1 to 8 atom%.

* * * * *